US006840438B2

(12) United States Patent
Hassan

(10) Patent No.: US 6,840,438 B2
(45) Date of Patent: Jan. 11, 2005

(54) THEFT PREVENTATIVE MAILBOX WITH UNDERGROUND STORAGE CAPACITY AND MAIL RETRIEVAL MECHANISM

(76) Inventor: Shawky Hassan, 1146 S. Linden, Flint, MI (US) 48532

( * ) Notice: Subject to any disclaimer, the term of this patent is extended or adjusted under 35 U.S.C. 154(b) by 0 days.

(21) Appl. No.: 10/391,949

(22) Filed: Mar. 18, 2003

(65) Prior Publication Data

US 2003/0218059 A1 Nov. 27, 2003

Related U.S. Application Data

(63) Continuation-in-part of application No. 09/728,798, filed on Dec. 1, 2000, now Pat. No. 6,533,167.

(51) Int. Cl.[7] ..... B65G 11/04
(52) U.S. Cl. ..... 232/54; 232/45; 232/39
(58) Field of Search ..... 232/45, 53, 54, 232/17, 43.1, 43.3, 30–32, 39

(56) References Cited

U.S. PATENT DOCUMENTS

| | | | | | |
|---|---|---|---|---|---|
| 378,955 | A | * | 3/1888 | Dubey | 232/30 |
| 403,790 | A | * | 5/1889 | Taylor | 232/24 |
| 450,379 | A | * | 4/1891 | Sinclaire | 238/49 |
| 476,692 | A | * | 6/1892 | Shuman | 232/45 |
| 533,518 | A | * | 2/1895 | Witte | 232/54 |
| 555,948 | A | * | 3/1896 | Harrison et al. | 232/49 |
| 626,251 | A | * | 6/1899 | Teevan et al. | 232/54 |
| 671,692 | A | * | 4/1901 | Daly | 232/45 |
| 722,323 | A | * | 3/1903 | Parker | 232/54 |
| 787,476 | A | * | 4/1905 | Sheley | 232/31 |
| 1,048,409 | A | * | 12/1912 | Hoskins | 232/54 |
| 1,151,666 | A | * | 8/1915 | Cullen | 232/17 |
| 3,593,914 | A | | 7/1971 | Van Orden | 232/47 |
| 4,114,801 | A | | 9/1978 | Van Orden | 232/17 |
| 4,403,760 | A | | 9/1983 | Alvermann | 248/284.1 |
| 4,844,332 | A | * | 7/1989 | Long | 232/17 |
| 5,065,975 | A | * | 11/1991 | Giles | 248/545 |
| 5,096,115 | A | | 3/1992 | Hassan | 232/17 |
| 5,271,555 | A | | 12/1993 | Mayer | 232/17 |
| 5,351,883 | A | * | 10/1994 | Pachl | 232/17 |
| 5,433,376 | A | | 7/1995 | Kueshner | 232/39 |
| 5,573,178 | A | | 11/1996 | Worden | 232/24 |
| 5,632,441 | A | | 5/1997 | Toval | 232/17 |
| 5,938,113 | A | * | 8/1999 | Kim | 232/47 |

* cited by examiner

*Primary Examiner*—William L. Miller
(74) *Attorney, Agent, or Firm*—Gifford, Krass, Groh, Sprinkle, Anderson & Citkowski, P.C.

(57) ABSTRACT

A theft-preventative mailbox for holding various sizes of mail correspondence and mail parcels. The mailbox includes an elongate and internally hollowed body with a mail correspondence insertion slot at a generally upper end location. The body further includes a mail storage compartment, and the body is further fixedly anchored at a ground location so that at least a portion of the mail storage compartment extends below a surface of the ground location. An access door is defined within the body and permits the depositing of mail parcels into the storage compartment. A constriction skirt is secured to the interior of the mailbox body and includes a plurality of inwardly directed and pointed spear portions for permitting one-way depositing of mail correspondence and mail parcels. A mail retrieval mechanism acts in concert with the parcel access door to permit the retrieval of the mail correspondence and mail parcels deposited within the storage compartment.

18 Claims, 10 Drawing Sheets

THEFT PREVENTATIVE MAILBOX WITH UNDERGROUND STORAGE CAPACITY AND MAIL RETRIEVAL MECHANISM

CROSS REFERENCE TO RELATED APPLICATIONS

The present application is a continuation-in-part of U.S. application Ser. No. 09/728,798, filed Dec. 1, 2000, now U.S. Pat. No. 6,533,167, for a Theft Preventative Mailbox with Underground Storage Capacity and Mail Retrieval Mechanism.

BACKGROUND OF THE INVENTION

1. Field of the Invention

The present invention relates generally to mailbox apparatuses and, more particularly, to a theft preventative mailbox which is fixedly anchored to a ground location, extending above the ground, and including underground storage capacity for maintaining quantities of mail in a secure manner. The present invention further discloses a mail retrieval mechanism for permitting the addressee to retrieve the mail from the underground stored location.

2. Description of the Prior Art

The prior art is well documented with varied examples of mailbox storage and mailbox theft preventative assemblies. The objective in each instance is to safeguard either or both the mail and the mail holding device from the time the mail delivery person deposits the mail until the addressee has an opportunity to collect the mail.

U.S. Pat. No. 5,632,441, issued to Toval, discloses a mechanism for elevating and lowering a mailbox assembly relative to a ground location and which includes a mail receiving box maintained in an automated elevator mechanism under the control of a timer circuit. The mail receiving box emerges and remains in an erected attitude over a time period when the mail is to be delivered and then retracts below ground, such as in the evening and night, to remain protected against vandalism. In a preferred embodiment, a jack screw is employed as the mechanical system that is turned to lift and lower a platform supporting the mail receiving box and includes limit switches to stop platform travel at the limits of screw jack travel. A timer arrangement commands operation of an electric motor to turn the screw jack to raise and lower the platform at set times, such as when mail delivery is anticipated, and includes a capability for remote control of the electric motor operation for overriding the timer to command system operation.

While providing a unique device for safeguarding the mail receiving box itself from vandalism, such as in rural locations in the evening and at nighttime, the device of Toval does not take into account any type of underground storage capability for the mail deposited within the receptacle device. Furthermore, the concept of selectively elevating and lowering an entire mailbox assembly into and out of a ground location requires that the source of AC input power be constant and guaranteed, as well as that the elevating mechanism work properly in all types of weather, such as winter in which freezing ground conditions are common. Additionally and/or alternatively, the failure or improper operation of the timer circuit may result in the mailbox device not elevating at the appropriate time, thus resulting in no mail being delivered.

U.S. Pat. No. 5,096,115, issued to Hassan, discloses a mail theft-preventative mailbox having a mail receiving end, a mail storage end, and an inclined and intermediate body portion disposed therebetween. The mail receiving end has an outgoing mail holding shelf provided therein and a pivotally attached door. The mail storage end holds the received mail and includes a lockable mail access door for removal of the mail. The back side of the mail storage end is flat and includes an upper extending flange allowing for placement of the mailbox on a conventional mail post. The inclined body portion is further long enough and sufficiently angled to prevent removal of mail by reaching into the mail receiving end.

SUMMARY OF THE PRESENT INVENTION

The present invention is a theft-preventative mailbox for holding various sizes of both mail correspondence and larger sized and mailable parcels and which provides the combined features of permitting convenient access to the mailbox interior by the mail carrier in order to deposit both the correspondence and larger sized parcels, as well as providing a convenient means for the addressee to quickly and effectively retrieve his mail. The anti-theft device of the present invention also provides a substantially underground storage compartment of sufficient depth that it prevents against any unauthorized individuals attempting to access the mail, by hand or by the use of any manipulable structure.

The mailbox includes an elongate and internally hollowed body with a mail insertion slot configured at a generally upper end and which permits the receipt of relatively thin cross sectional mail correspondence. A mail parcel access door is preferably located in one of two preferred positions, the first being hingedly secured to a front surface of the elongate body and the second being hingedly secured to a top surface of the body above the correspondence insertion slot. The elongate and internally hollowed body defines a mail storage compartment at a substantially lower end and the elongate body is fixedly anchored at a ground location so that at least a portion of the mail storage compartment extends below a surface of the ground location.

A mail retrieval mechanism acts in concert with the parcel access door and permits the retrieval of the mail correspondence and mail parcels by the addressee. The mail retrieval means further includes a platform defined within the elongate and internally hollowed body and upon which is supported the deposited mail correspondence and mail parcels. A bi-directional drive assembly selectively elevates the platform proximate the retrieval door configured within the body and in a mail correspondence and mail parcel retrieval position. The drive assembly lowers the platform to the below ground location in a further mail depositing position and after the mailable items have been successfully retrieved.

In one preferred variant, the mail retrieval mechanism includes an elongated and flexible bag which is secured in substantially vertically extending fashion within the hollowed interior by eyelets formed around an open periphery of the bag and which are received upon suspending nubs extending inwardly from the body interior. The bag is positioned in such proximity to the door that the addressee can effectively retrieve the bag upon unlocking and opening the door.

In a further preferred variant, the mail retrieval mechanism is constructed with a bi-directional drive mechanism operated by an electric motor and for raising and lowering a platform arrayed within the elongate extending interior of the body. The bi-directional drive can include a vertically extending and exteriorly threaded jack screw which is rotatably supported and driven at a lower end by an electric motor and which is likewise rotatably supported at an upper end by an annular collar extending from an underside of the mail supporting platform.

In another application, the bi-directional drive is constructed as an elongated and looped belt which is secured against an inside surface of the internally hollowed body by first and second gears. The platform is in turn secured to an exteriorly facing location of the belt and in such a manner that it can bear the combined weight of the platform and the mail correspondence and parcels supported thereon. In a yet further application, a manual hand crank winding mechanism is incorporated into the design of the elongate extending body and is operable by the user to elevate the platform for mail retrieval.

In a still yet further application, the platform is elevated and lowered by a vertically actuated and elongate cylinder. The cylinder is fluid operated, such as pneumatically with air or with other hydraulic fluids, to selectively extend or retract a piston arm, an upper end of which is secured to an underside of the platform.

To further assist in theft-preventative holding of the mailable correspondence and parcel items, a constriction skirt is secured around the internally hollowed body and includes a plurality of circumferentially arrayed, flexible, arcuate and inwardly extending spear portions with substantially pointed ends. The constriction skirt permits, in particular applications, one way conveyance of the mail parcels, such as by a mail delivery person through an upper portion of the mailbox hingedly secured to the elongate body. The mail may therefore be inserted at a location above the skirt, passed through the flexible spear portions of the constricting skirt, and resting in the lower storage compartment, while at the same time preventing unauthorized individuals from retrieving the items. The access door is located in the front face of the body at a position below the arcuate skirt and so that, upon being opened by either the mail delivery person or the addressee, the mailable items can be quickly retrieved.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
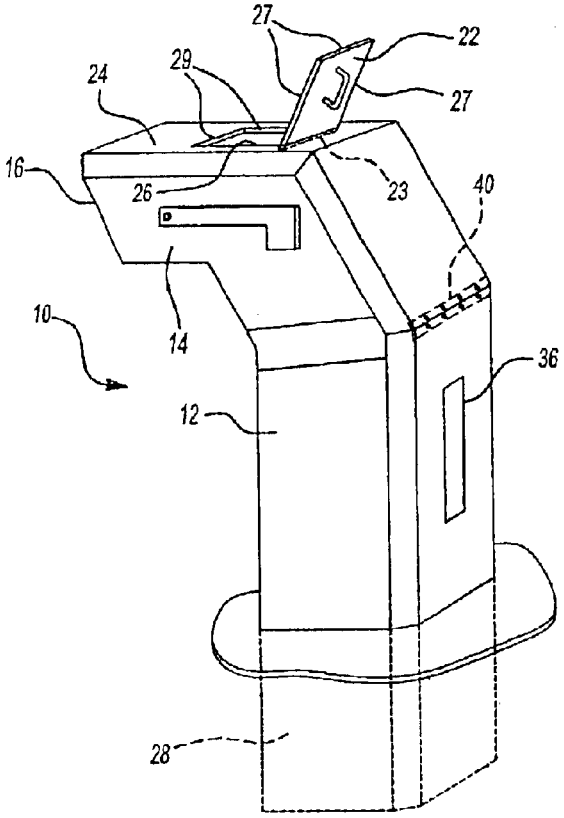
FIG. 1 is a perspective view of the theft preventative mailbox with underground storage capacity and mail retrieval mechanism according to a first preferred embodiment of the present invention.

Referring now to FIG. 1, a theft-preventative mailbox is illustrated at 10 according to a first preferred embodiment for holding various sized mail correspondence and mail parcels in a secure manner. The mailbox 10 is constructed so that it is particularly capable of holding large volumes of both mailable correspondence and larger mailable parcel items (not shown) and which can be quickly and effectively deposited by a mail carrier and retrieved by the addressee.

Figure 2:
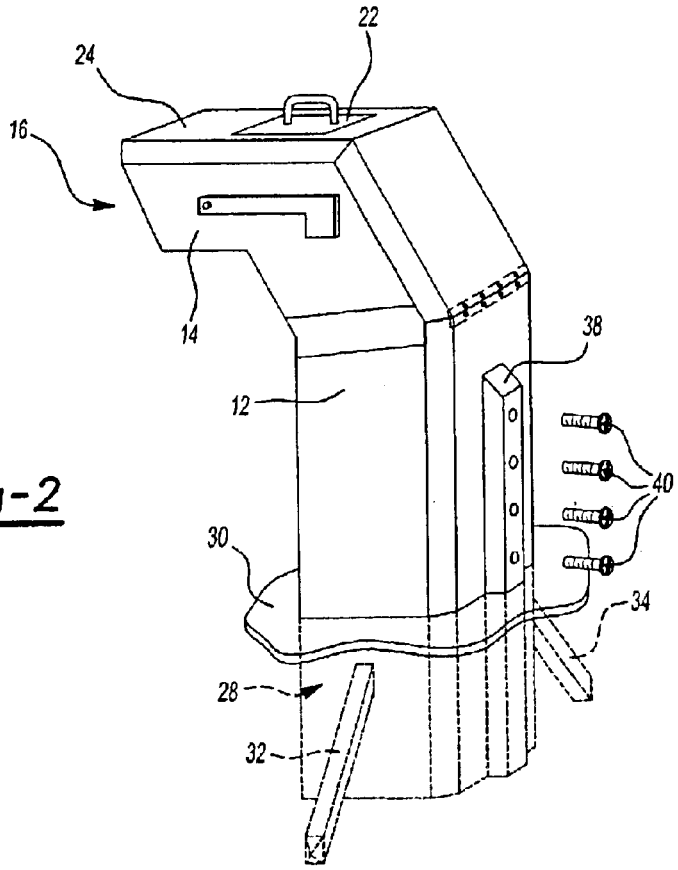
FIG. 2 is an environmental view, in perspective, of the mailbox shown in FIG. 1 and further illustrating the manner in which the mailbox is anchored within the ground so as to include an above ground compartment and a below ground mail storage compartment.
Figure 3:
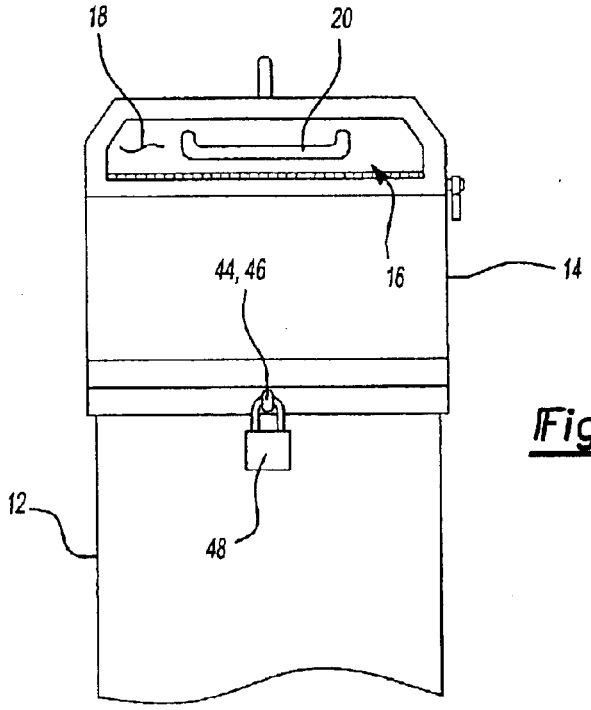
FIG. 3 is a frontal view of the mailbox.
Figure 4:
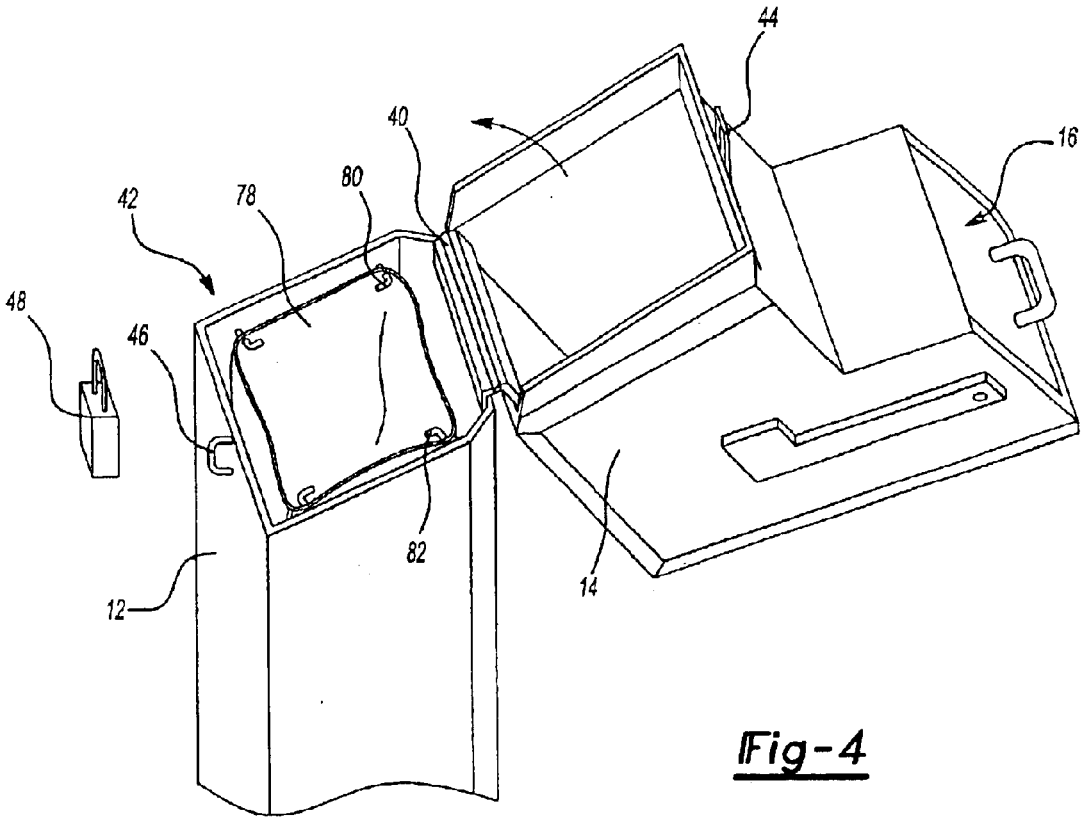
FIG. 4 is an actuated view in perspective of the mailbox design according to the first preferred embodiment and illustrating the angled and mail inserting end pivotally opened relative to the elongate body.
Figure 4A:
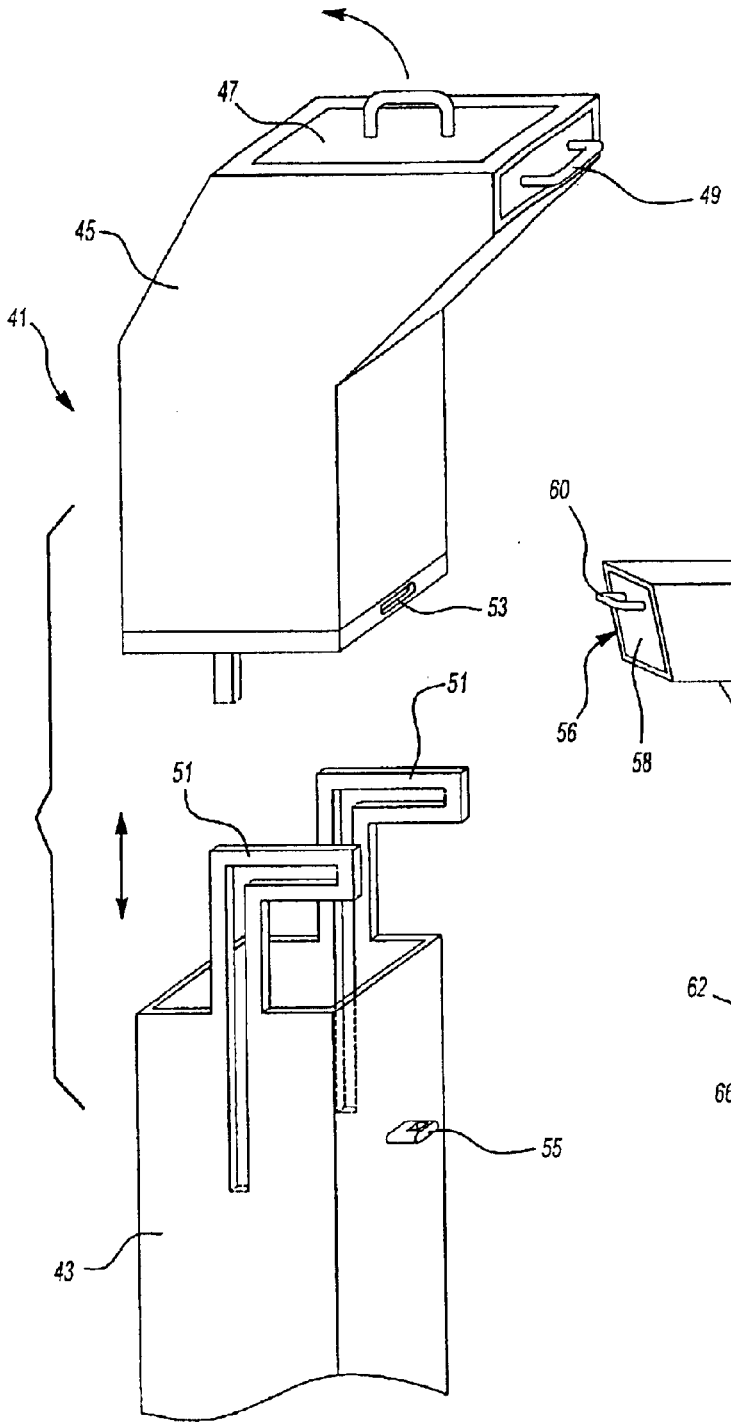

Referring again to FIG. 1, in combination with FIGS. 2–4, the mailbox 10 is preferably constructed of a lightweight and durable plasticized material and includes an elongate and internally hollowed body 12 terminating, at a generally upper end location, in an angled mail inserting end 14 and within which a mail insertion slot 16 is defined. A door 18 actuated by an integrally configured handle 20 is provided for opening and closing the door and so as to reveal the mail insertion slot (see as best shown in FIG. 3).

A mail parcel access door 22 is hingedly configured along a top surface 24 of the mailbox 10, above the mail insertion slot 14, and defines a sufficient opening 26 to permit the insertion of larger sized parcels (not shown) within the mailbox interior. Referring again to FIGS. 1 and 2, the mailbox body 12 also includes a generally downwardly extending and mail storage compartment 28. In a preferred variant, the mailbox 10 is fixedly anchored at a ground location 30 (see FIG. 2) so that a portion or all of the mail storage compartment 28 extends below the level surface of the ground 30. Anchoring structures, such as stakes 32 and 34, extend downwardly and outwardly in a desired manner from a buried location of the mailbox 10 and so that the stakes are embedded within the ground to prevent forcible removal of the mailbox 10 therefrom. Referring again to FIGS. 1 and 2, a locating surface 36 is identified along a rear surface of the mailbox 10 and upon which may be secured a beam support 38 (see FIG. 2) such as through the provision of screws 40 or other suitable mounting fasteners. The beam support 38 is generally useful in providing additional anchoring support to the embedded mailbox 10, in addition to the stakes 34 or other suitable structure.

Referring again to FIG. 4, the upper mail inserting end 14 of the mailbox body 12 is illustrated hingedly secured, at 40, to the elongate body 12 and so that the generally elongate and internally hollowed body is illustrated at 42. The hingedly secured upper end 14 provides a first preferred variant for facilitating the depositing of larger sized mail parcels and in addition to the ability to insert smaller and narrower sized mail correspondence through the mail insertion slot 16.

A locking mechanism is illustrated and includes a first latch portion 44 extending from an underside of the hingedly associated upper mail inserting end 14, and which seats within an appropriately configured latch recess 46 formed within an associated location along the main body 12 and so that, upon aligning the latch portions 44 and 46 by closing the upper mail inserting end 14, a conventional padlock 48 or other suitable locking device is employed. The locking mechanism illustrated provides but one alternate variant for locking the hingedly associated upper end 14 to the main body 12 and it is envisioned, as will be further explained, that either a mail delivery individual, and in most instances the addressee, can access the sizable and elongated interior 42 of the mailbox body in order to deposit any larger sized parcels.

Figure 5:
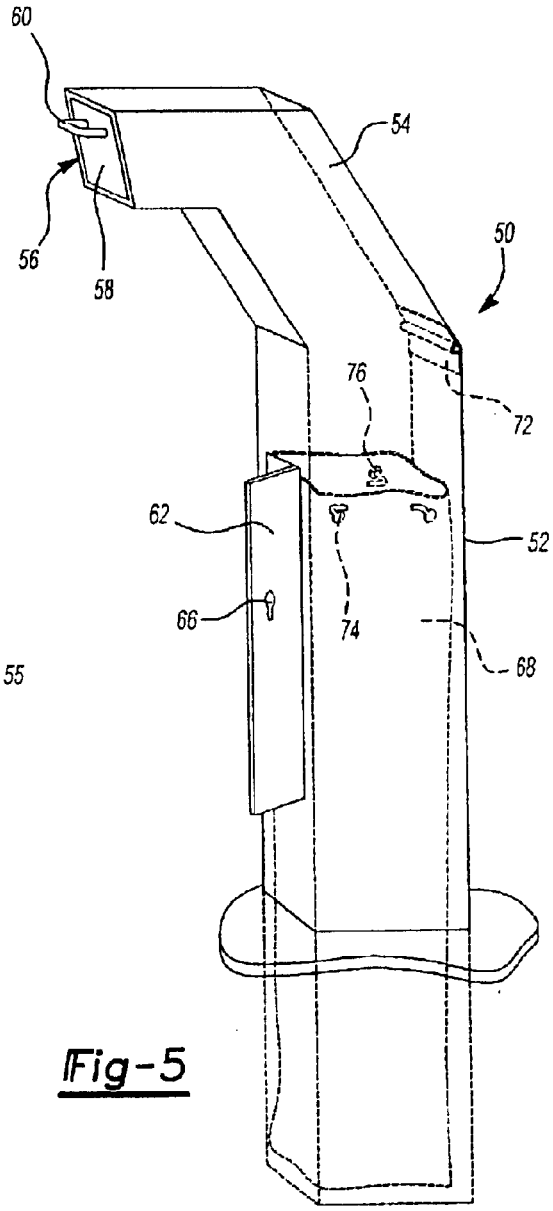
FIG. 5 is a side perspective view of the theft preventative mailbox according to a further preferred variant of the present invention and illustrating in phantom the mail retrieval bag and forwardly opening mail access door.

Referring now to FIG. 5, a first alternate variant is illustrated at 50 of the theft preventative mailbox is illustrated and includes a generally elongated body 52 with an upper and forward angled end 54, defining a mail insertion slot 56, and covered by a hingedly secured door 58 having a contoured gripping handle 60. The variant 50 further includes a door 62 hingedly secured to a front face 64 of the elongate and internally hollowed body 52. A locking mechanism 66 is associated with the door 62 and typically may include a conventional keylock portion, within which a key (not shown) is inserted to facilitate access to the mailbox interior so as to permit the depositing of the larger sized mail parcels.

Illustrated in phantom in FIG. 5 is an elongated bag 68 which is shown suspended from the interior of the internally hollowed body of the mailbox 50. The purpose of the bag 68 is to capture mail correspondence which is inserted through the mail insertion slot 56 (see also door 58 with handle 60) as well as larger sized mail parcels and packages which are inserted by pivotally actuating the upper and forward angled end 54 about a hinged connection 72 with the mail body 52 and as illustrated in the variant of FIG. 4. The elongated and flexible bag 68 is suspended within the body interior through the provision of eyelets 74 formed within the bag and proximate the upper and open end thereof. A plurality of suspending nubs 76 extend inwardly from the inner facing walls of the internally hollowed body and engage through the eyelets 74 for suspending the bag 68. The door 62 is typically opened, such as by the addressee, to permit the mail bag 68 to be dismounted from the mailbox body interior and to be withdrawn from body. Alternatively, the mail correspondence and mail parcel items can be removed by hand from the mailbox interior while leaving the bag 68 in place.

Referring again to the preferred embodiment illustrated in FIG. 4, a likewise configured receiving bag 78 can be installed in similar fashion within the elongate extending body interior, such as through the use of eyelets 80 formed in the bag again proximate its upper periphery and which are engaged by suspending nubs 82 extending inwardly from the inner surfaces of the mailbox interior. It is worthy to note that the embodiment of FIGS. 1–4 does not include a frontal access door (as illustrated at 66 in FIG. 5) and that both parcel insertion and retrieval is accomplished through the pivotally associated upper mail inserting end 14.

Figure 6:
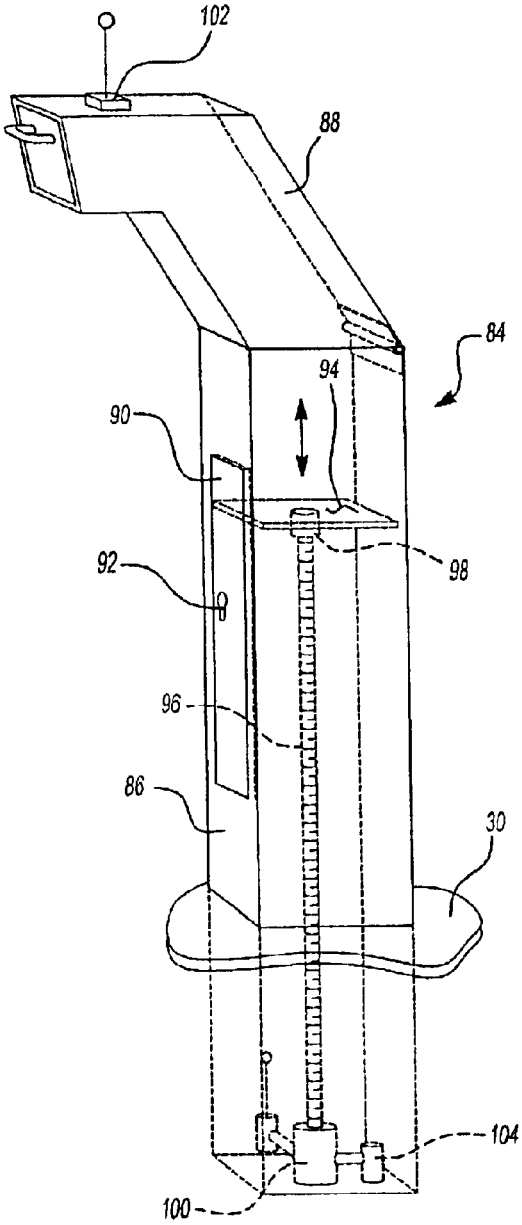
FIG. 6 is a further side view in cutaway of the theft preventative mailbox according to a yet further preferred variant and illustrating a electrically operable jack screw and platform assembly for facilitating mail retrieval.

Referring now to FIG. 6, a first variant is illustrated, at 84, of a theft preventative mailbox design utilizing a powered and bi-directional drive assembly for permitting retrieval of the mail correspondence and mail parcel packages. Specifically, the mailbox 84 again includes an elongate and axially extending body 86, a sufficient distance of which extends below the ground level 30 so as to define a subterranean storage compartment, the mailbox 84 as well including an upper and forwardly angled end 88, an access door 90 hingedly secured to a front face of the mailbox 84 and including a keylock 92 for permitting selective access to the mailbox interior.

As best illustrated in the interior cutaway of FIG. 6, a platform 94 is configured so as to be horizontally arrayed and supported within the elongate and vertically extending interior of the mailbox 84 and upon which is supported the mail correspondence and mail parcels/packages deposited within the mailbox interior. The platform 94 is supported at an underside surface by the bi-directional drive which, in the instant embodiment disclosed, includes a vertically extending and exteriorly threaded jack screw 96 mounted so as to extend substantially vertically within the elongate and internally hollowed body interior. The platform 94 is secured, via a rotating annular collar 98, to an upper end of said jack screw 96. A corresponding and opposite lower end of the jack screw is rotatingly supported and driven by an electric motor 100, which in turn is fixedly secured within the body interior at the underground location and through which the jack screw is rotatably translated in either clockwise or counterclockwise fashion so as to elevate and lower the platform.

The bi-directional drive assembly selectively elevates the platform 94 proximate the door, 92 in a mail correspondence and mail parcel retrieval position and correspondingly lowers the platform 94 to the below ground location in a further mail depositing position. A remote control mechanism may be incorporated into the mailbox assembly and includes a receiver 102 incorporated into the mailbox body at an appropriate location and which communicates with the electric motor 100, such as through radio frequency or direct wire communication, and so that the motor is selectively activated to elevate the platform for retrieval of the mailable items. An appropriate power input 104 (such including either AC power input or a portable battery) provides the power input to elevate and lower the platform and the rating of the motor 100 and structural capacity of the jack screw 96 is further such that it is capable of supporting and elevating a desired combined weight of combined mailable items.

Figure 7:
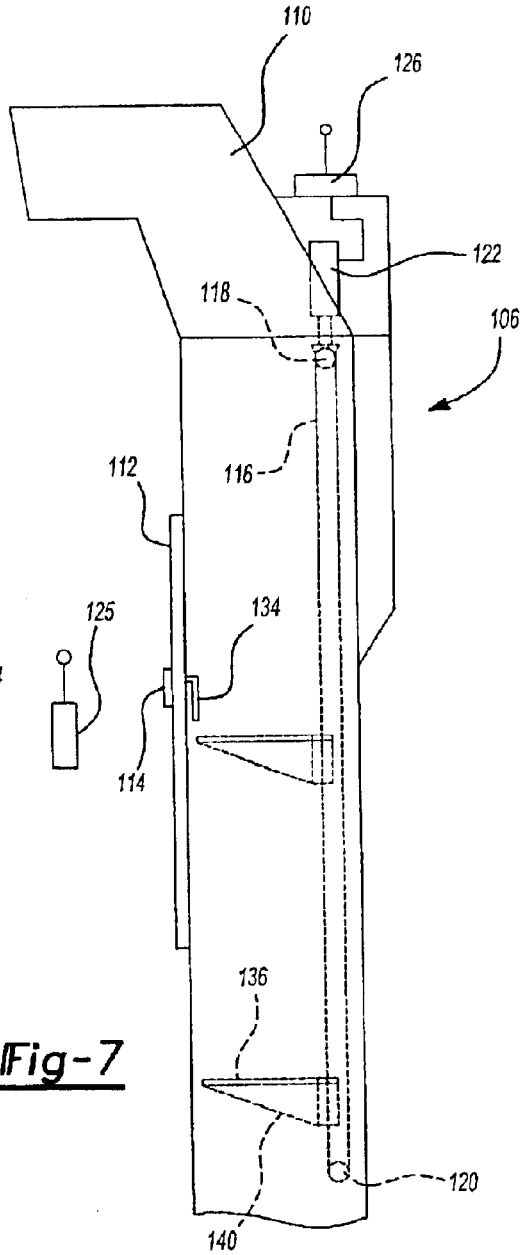
FIG. 7 is a further modification of the theft preventative mailbox and illustrating a remote controlled and electrically operable and belt lift mechanism for facilitating mail retrieval.

Referring now to FIG. 7, a further variant 106 of a bi-directional drive assembly is illustrated for use with the theft preventative mailbox, the mailbox again including a generally vertically extending and elongate body 108, partially embedded so that a lower end of the body defines an underground storage compartment, and further including an upper and forwardly angled end 110 and which is hingedly openable or actuable as illustrated in the earlier preferred variant of FIG. 4. Also again shown is door 112 hingedly secured to a front surface of the mailbox and includes a locking mechanism 114 for permitting selective opening of the door.

Figure 8:
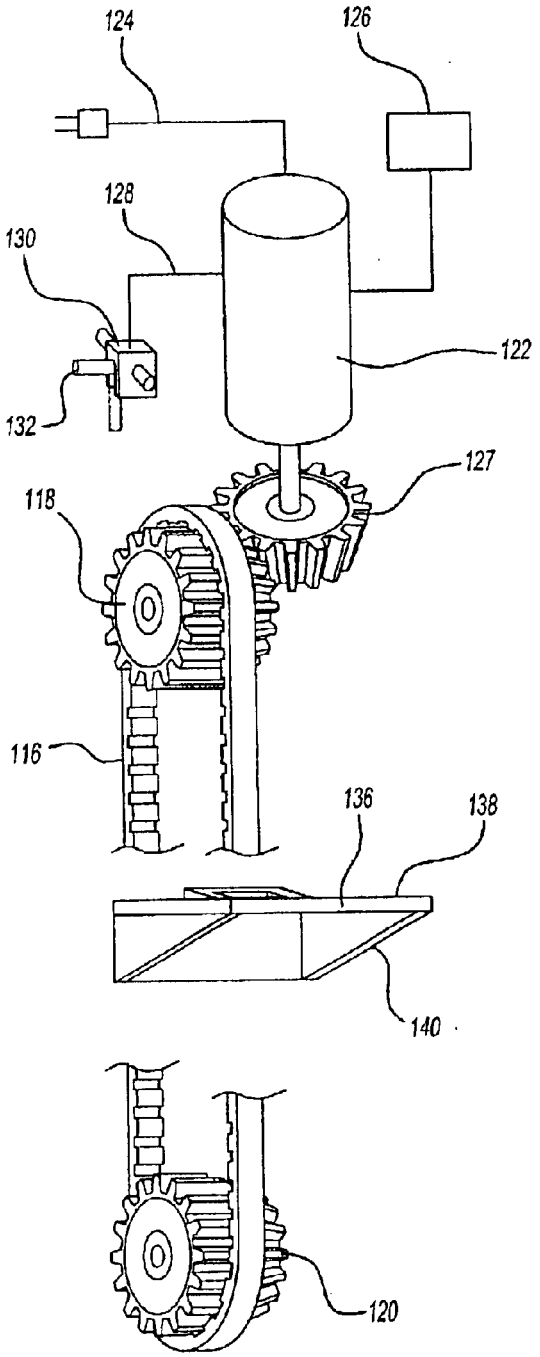
FIG. 8 is a sectional view in perspective of the belt lift mechanism illustrated in FIG. 7 and further showing the mail scoop portion fixed to the bi-directionally actuable belt.

Referring again to FIG. 7, and also to FIG. 8, the bi-directional drive assembly according to the further preferred variant includes an elongated and looped belt 116 secured against an inside surface of said internally hollowed body by first 118 and second 120 gears. The belt 116 is preferably constructed of a durable and flexible rubberized material and the gears 118 and 120 may include teething appropriate for gripping the inner corresponding surface of the belt 116, the belt further potentially including a mesh configuration or other known shaping such that the teething in the gears 118 and 120 fixedly engages the belt 116 in a non-slip manner.

An electric motor is again illustrated at 122 and from which extends a first line 124 from which the power source is derived. A remote transmitter is illustrated at 125 (in FIG. 7) and activates a receiver 126, in turn connected to the electric motor 122 in FIG. 8. The motor 122 connects to the gear 118 (or upper gear) via a downwardly extending bevel gear 127 and drives the gear 118, and consequentially the belt 116 and the lower gear 120, upon activation of the power supply. A further modification of the lock/unlock structure is illustrated at 130, which works in cooperation with the locking structure previously identified at 114, and which is connected to a power line 128 extending from the input power supply 124. The powered locking portion includes a locking tab 132 which is rotated from a locking position in which it abuttingly engages a suitably configured portion 134 forming a part of the door assembly 112 to an unlocking position in which the door is automatically unlocked concurrent with the actuation of the powered drive assembly. A platform 136 is secured to an exterior facing location of the belt 116 in a suitable manner such as through the provision of angled end brackets 138 and 140 and so that the platform 136 can suitably bear the weight of the inserted mail correspondence and mail parcels during the storing and retrieval stages. Referring again to FIG. 7, the level of actuation of the platform 136 from the stored and mail receiving position to the retrieval position (indicated in phantom at 136') is shown. The motor 122 is further shown mounted at a generally upper end of the housing structure of the mailbox in FIG. 7 consistent with the disclosure provided in FIG. 8.

Figure 9:
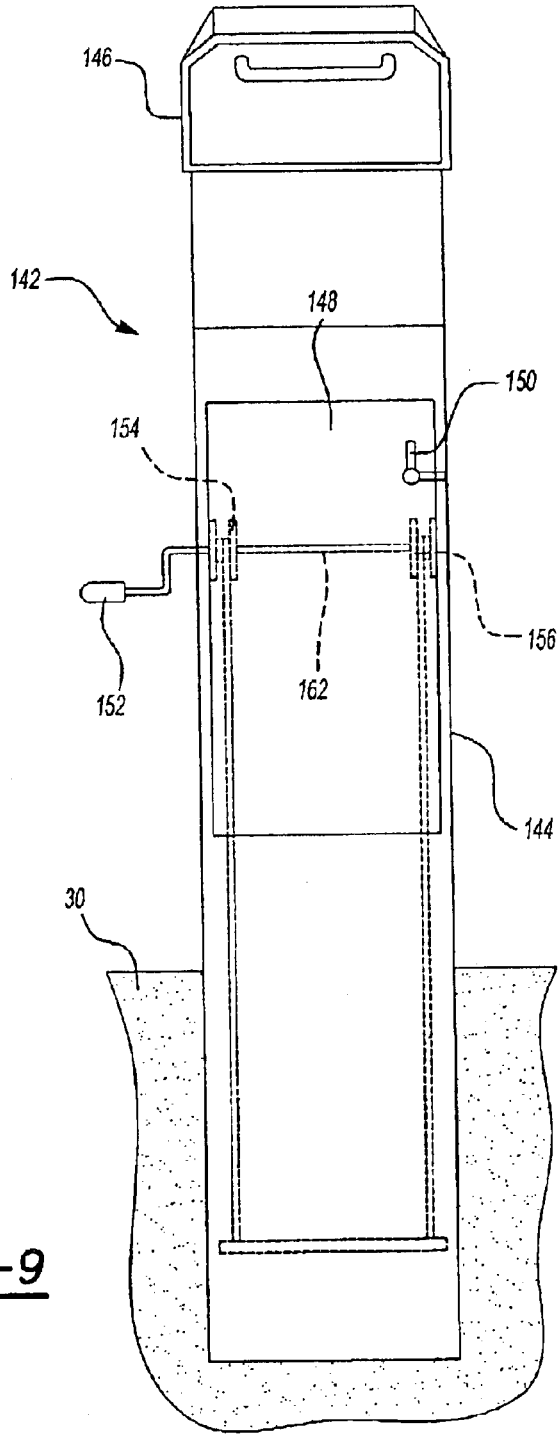
FIG. 9 is frontal view of a theft preventative mailbox according to a still further preferred variant and showing a manually operable crank mechanism for elevating a mail retrieval platform.
Figure 10:
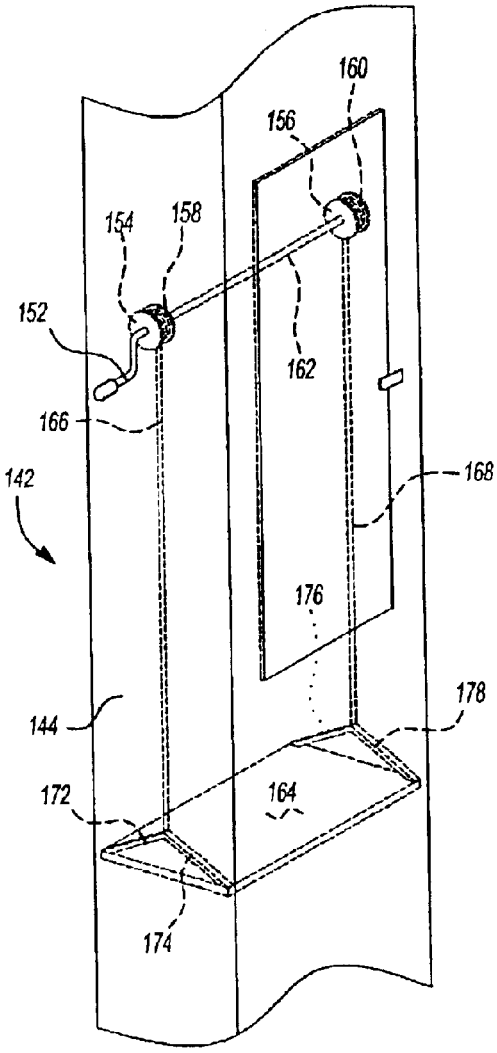
FIG. 10 is a perspective view in section of the mailbox shown in FIG. 9 and illustrating in further detail the manually operable crank mechanism.

Referring now to FIGS. 9 and 10, in combination, a yet further variant of the mailbox design is illustrated at 142. The mailbox structure itself is again largely identical in this variant to that previously disclosed and includes the main elongate and internally hollowed body 144 (with underground extending storage capacity), the upwardly and forwardly angled mail insertion end 146 (again which may be pivotally configured relative to the main body 144), and the forwardly positioned access door 148 which may include locking assembly 150.

The variant of FIGS. 9 and 10 differs in that the bidirectional drive assembly is manually operated. Specifically, the drive assembly includes a manually operable winding mechanism including a hand crank assembly 152. Preferably, the crank assembly 152 further includes a first winding wheel 154 secured in rotatable fashion against a first inner side surface of the body and a second like winding wheel 156 secured at a suitable location along a second opposing and inner side surface of the body. Each of the winding wheels 154 and 156 includes an inwardly curved and annular receiving surface, such as at 158 and 160, respectively. A stem 162 extends between the wheels 154 and 156 and, through the rotatable input of the crank 152 drives the wheels in either a counterclockwise winding or clockwise unwinding direction.

A platform is shown at 164, again horizontally arrayed within the elongate extending vertical interior of the body. The platform 164 is vertically actuated in the bi-directional manner by first 166 and second 168 lengths of cord extending from the winding wheels 154 and 156, forming a part of the hand crank and selected surfaces of the platform 164. Specifically, the cords 166 and 168 may each include subset portions 172 and 174 (extending from cord 166) and subset portions 176 and 178 (extending from cord 168). The subset portions extend to opposite corner edge locations of the platform and bias it in a generally level location during the time in which main cords 166 and 168 are wound onto the configured annular surfaces 158 and 160 of the wheels 154 and 156 and the combined weight of the mail correspondence and mail parcels is elevate to the location proximate the entrance door 168.

Figure 15:
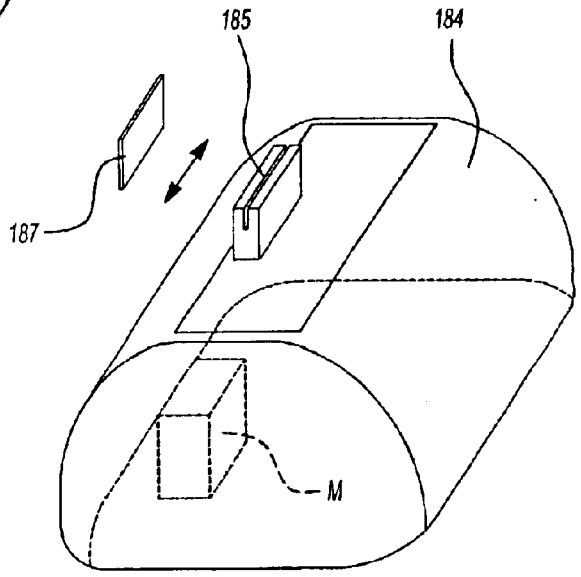
FIG. 15 is a partial perspective view of the outer shell of the mailbox according to FIG. 11 and further showing the pivotal association of the lid to the elongated body.

Referring now to FIGS. 11–15, a further variant of the mailbox is illustrated at 180 and includes a generally elongate and straight shaped body 182 (defining an open and extending interior) and which extends from an upper end to a lower and embedded end below the ground surface 30. A top 184 of the mailbox is generally arcuate shaped and may be hingedly secured onto the body 182, at 186 and as is generally illustrated in FIG. 15. A keycard and swipe reader (such as at 185 and 187 in FIG. 14) may be provided to permit selective access to the mailbox interior, such as for depositing mailable correspondence and parcels. It is envisioned that mail carrier, as well as an addressee, can possess a card reader for permitting access to the mailbox.

Referring again to FIG. 11, the bi-directional lift mechanism in the further preferred variant includes a vertically actuated and elongate fluid cylinder 188, the cylinder 188 including an outer and pneumatic or hydraulic fluid actuated tube and a piston arm 190 which extends from the outer tube 188 in telescoping fashion and which is actuated by either mechanical means and/or by a motorized input 192. A platform 194 is secured to an upper end of the piston arm 190 and is actuated in a manner as previously described, such as through the use of a remote controller 196 with a receiver configured for being displayed on an exterior surface of the mailbox body and connected to the activating motor 192 by a communication line 198.

Figure 11:
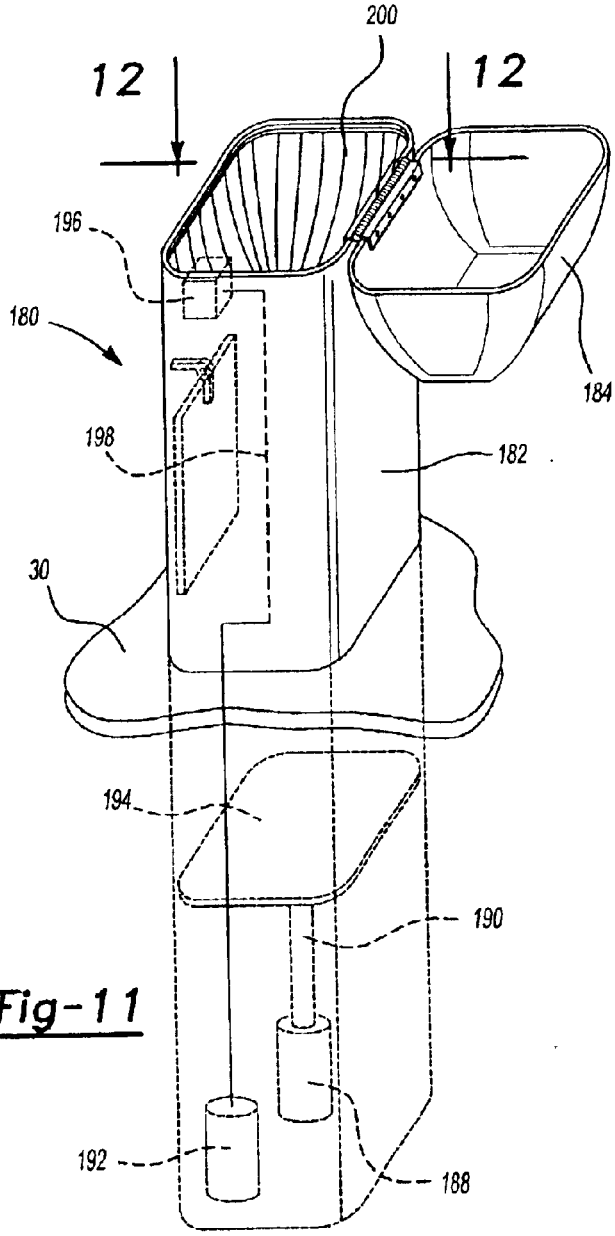
FIG. 11 is an exploded view of the theft preventative mailbox according to a yet further embodiment.

Referring again to FIGS. 12 and 13, another feature provided by the mailbox variant of FIG. 11 is a constriction skirt 200 secured within the internally hollowed body of the mailbox and such as is shown in FIG. 11. The skirt 200 includes a plurality of circumferentially arrayed, flexible, arcuate and inwardly extending spear portions 202 with substantially pointed ends 204. The constriction skirt 200 is mounted within the vertically extending and hollowed interior of the mailbox in such a fashion as to permit one way conveyance of the mail correspondence and mail parcels (not shown) to the lower storage compartment confines of the assembly and so that they come to rest upon the platform 194.

Figure 11A:
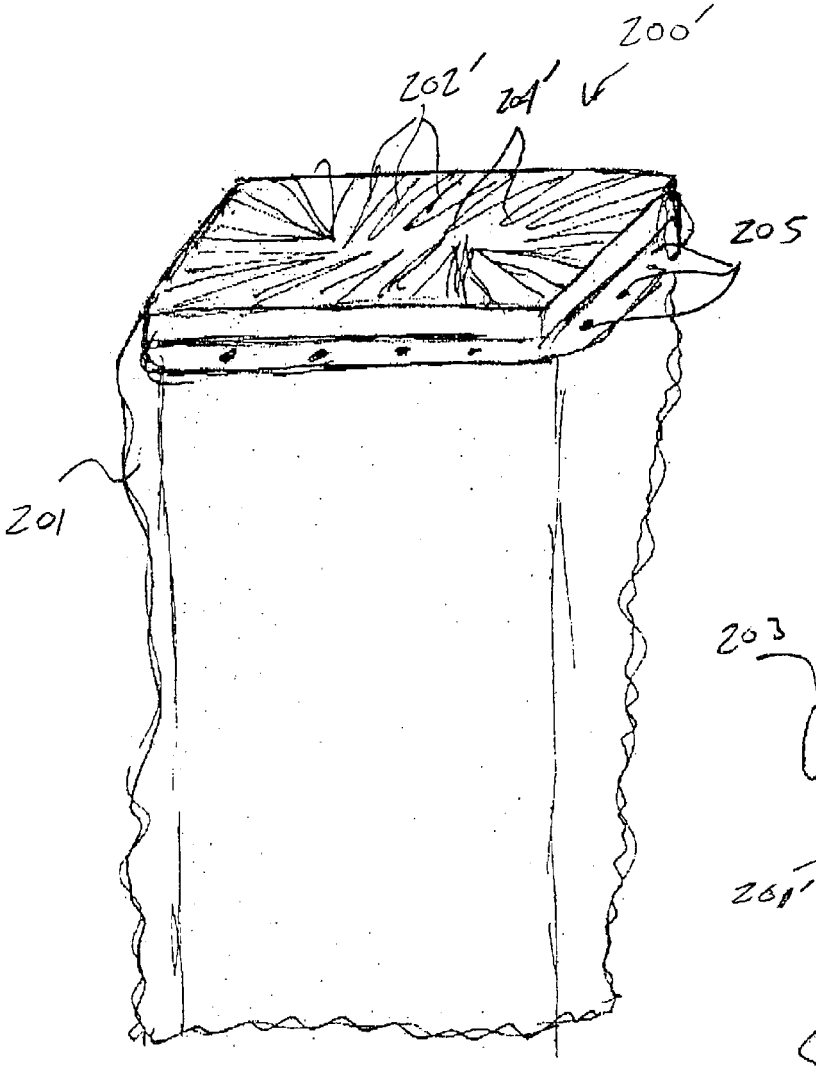
FIG. 11*a* is a modification of the embodiment of FIG. 11 and which illustrates the combination skirt and plastic spear portions incorporated into either a body of the mailbox or associated and insertable mailbag.

Referring to FIG. 11*a*, a further variant of the invention contemplates the provision of a flexible bag 201, about an upper end of which a modification 200' of the skirt is attached. The skirt 200' again includes a plurality of inwardly extending fingers 202' having substantially pointed ends 204'. As is also illustrated, a plurality of rivets 205, or other suitable fasteners, may be employed for attaching the skirt 200' to the open top end of the bag 201 and such as which may extend through the plastic rim portion associated with the skirt and in engagement with the underlying bag 201.

Figure 13A:
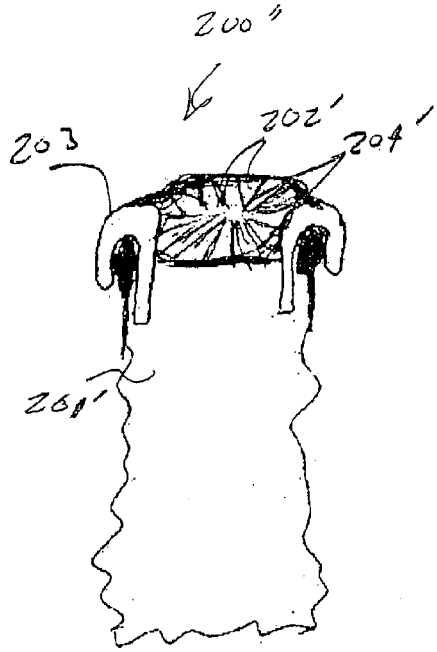
FIG. 13*a* is a side view of a combination skirt and mailbag and which further illustrates an annular extending and attachable lip for supporting the assembly within an interior of a mailbox body.
Figure 12:
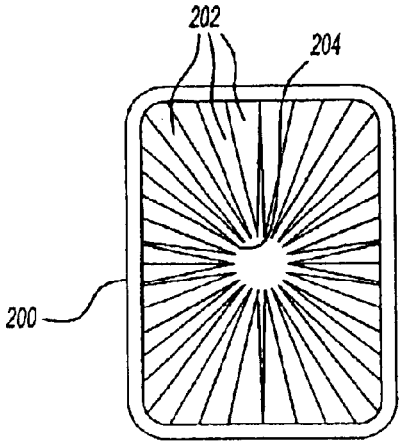
FIG. 12 is a top view taken along line 12—12 of FIG. 11 and showing the one-way mail insertion and constriction skirt according to the present invention.
Figure 13:
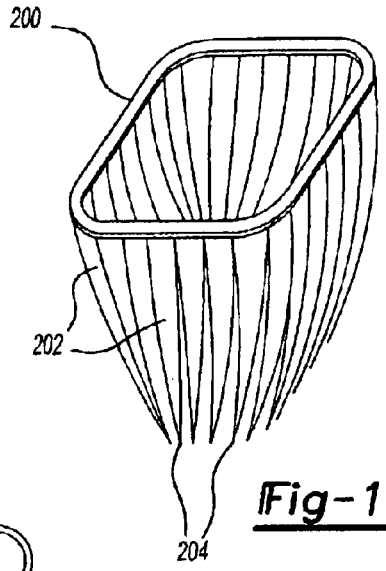
FIG. 13 is a further perspective view of the constriction skirt for facilitating theft preventative insertion of mail and mail parcels.
Figure 14:
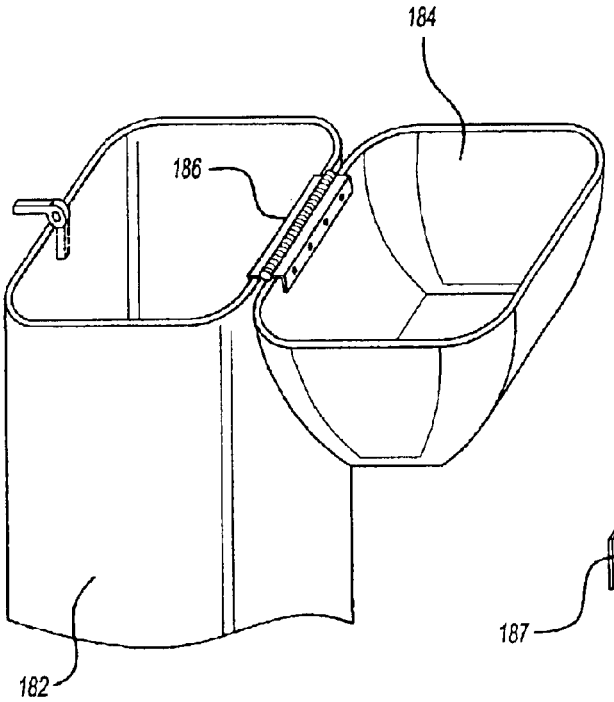
FIG. 14 is a sectional view illustrating a pivotally associated lid for the theft preventative mailbox according to FIG. 11 and further showing key-card access capability.

It is also contemplated that the spear portions 202' and inwardly pointed ends 204' can be directed in any angled fashion, such as is again shown in FIG. 11*a* or, alternatively, in the fashion previously illustrated in FIG. 13. Furthermore, the skirt (according to any modification disclosed herein) can be located and supported at any relevant position within the mailbox interior, and in order to deter theft of mail correspondence or packages inserted into either the mail insertion slot or even possibly the mail package door hingedly attached along a top or front facing side of the body. It is also contemplated and understood that the construction of the skirt is such that the spear portions flex in order to permit mail correspondence items (again namely letters and smaller sized packages) to pass therethrough and be collected at a safe and remote location within the mailbox interior.

As is further shown in FIG. 13*a*, a further variation of a combination skirt and mailbag is illustrated by skirt 200" secured to a variation of bag 201'. Further illustrated is an annular extending and attachable lip 203 (which may extend around the entire circumference of the bag, or which may also contemplate a plurality of circumferentially spaced apart and individual suspending lip portions) extending about a periphery of the bag upper end and for supporting the assembly within an extending interior of a mailbox body, such as is again referenced at 182 in FIGS. 11 and 14.

As also previously discussed, it is again contemplated that the skirt and spear portions, such as illustrated at 200, 200' and 200" can be incorporated directly into the assembly of the mailbox body, and again as well as into a bag insertable and suspended within the mailbox body interior. It is also contemplated that the skirt and spear portions can be constructed of any other suitable material and such as which is contemplated to provide a desirable degree of anti-theft deterrence, while at the same time not posing an undue hazard to an individual's hand and arm.

Figure 16:
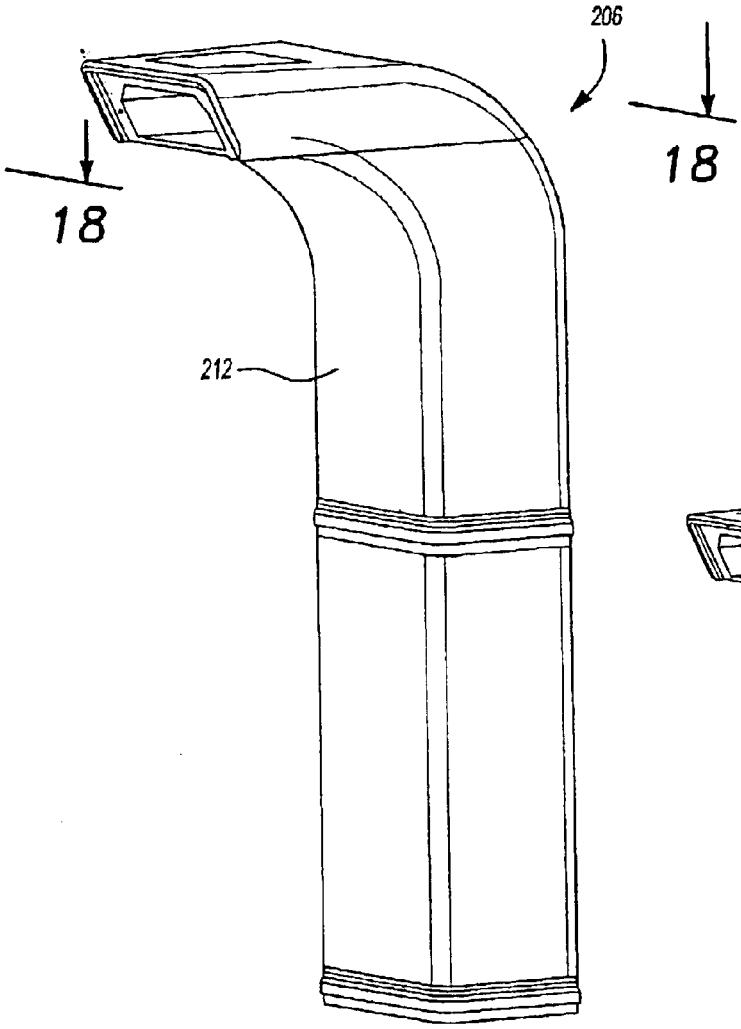
FIG. 16 is a perspective view of an external body design of the theft preventative mailbox according to a further preferred variant of the present invention.
Figure 17:
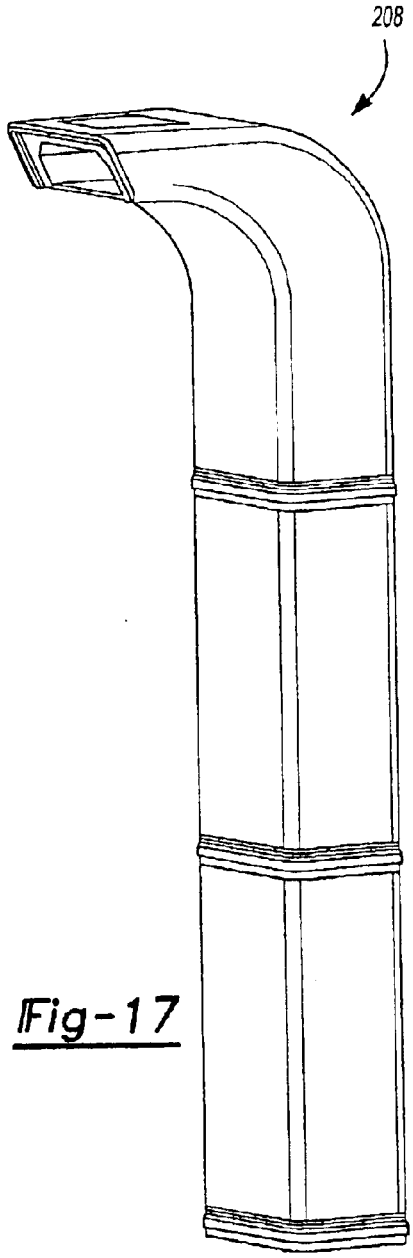
FIG. 17 is a perspective view of a further modified and external body design of the theft preventative mailbox and according to the present invention.
Figure 18:
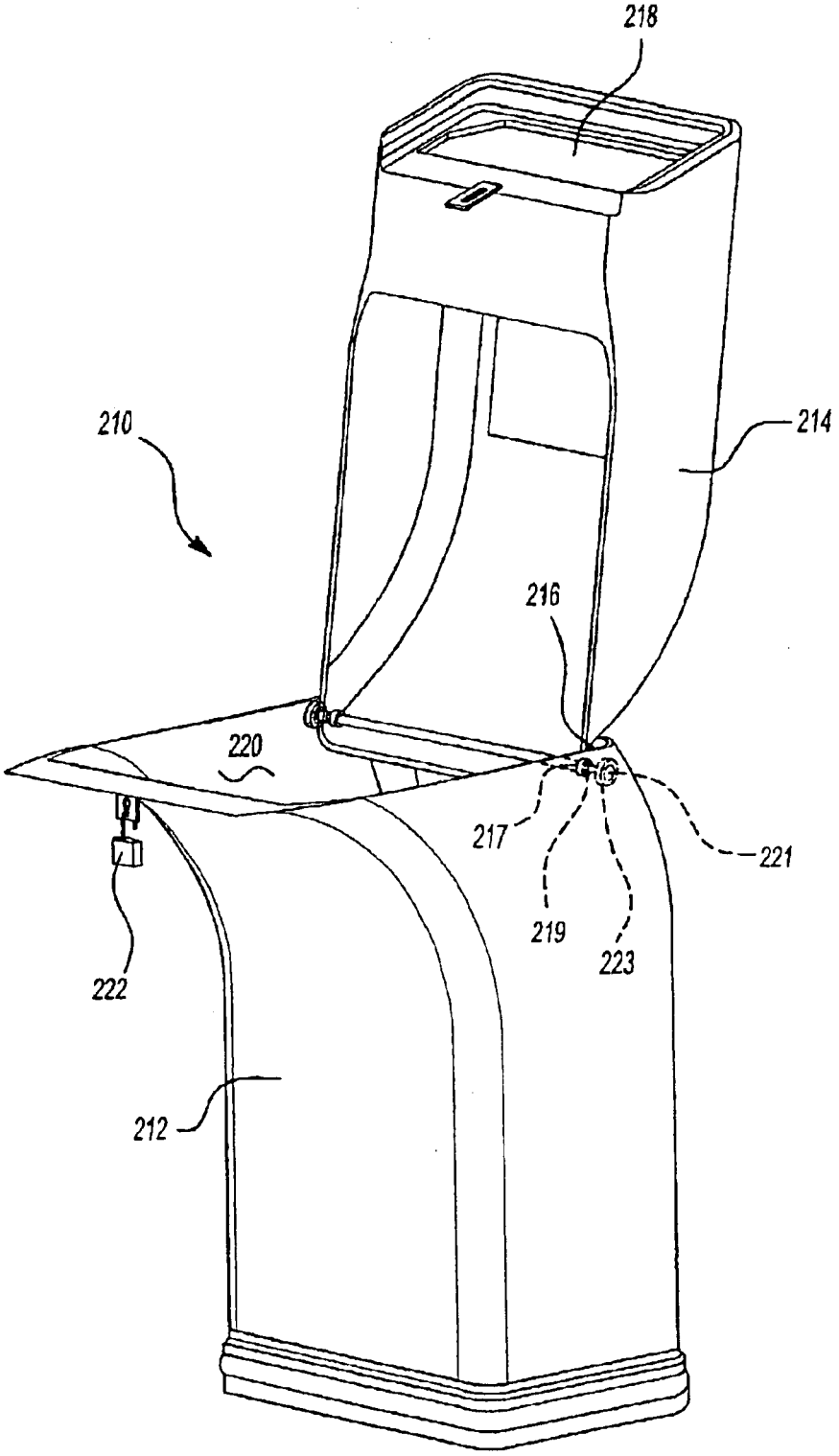
FIG. 18 is a cutaway view taken along line 18—18 of FIG. 16 and further showing the pivotal association of the mail insertion end relative to the elongate extending body according to the present invention.

Referring finally to FIGS. 16, 17, and 18, additional views in perspective are shown at 206, 208 and 210 of additional configurations of the theft-preventative mailbox design according to the instant invention. Referring particularly to the perspective illustration of FIG. 18, an upper mail inserting end 212 of the mailbox is shown and in which a top portion 214 is pivotally associated relative to an axis 216 formed crosswise between the top portion 214 and the opposing end of the main body 212 and for permitting introduction of mail parcels and other large items. Standard correspondence sized items are introduced through a slot 220 formed in the top portion 214, when the top portion is secured in place upon the mailbox body and so as to fall within open interior 220 defined within the body. A locking mechanism 222 is again provided for securing the top portion 214 in place upon the mailbox body.

Having described my invention, additional preferred embodiments will become apparent to those skilled in the art to which it pertains and without deviating from the scope of the appended claims.

I claim:

1. A theft-preventative mailbox for holding various sizes of mail correspondence and mail parcels, said mailbox comprising:

an elongate and internally hollowed body including, at a generally upper end location, a mail insertion slot, said body further including a mail storage compartment, at least a portion of which extends to a below ground location;

a skirt arranged within an interior of said hollowed body and at a desired location relative to at least said mail insertion slot, said skirt incorporating a number of inwardly directed and flexible spears, each exhibiting a substantially pointed end, the configuration of the spears being such that, in response to insertion of mail correspondence and parcels, said spears deflect to allow one way conveyance of deposited mail; and mail retrieval means in proximity to said mail storage compartment and permitting the retrieval of the mail correspondence and mail parcels.

2. A theft-preventative mailbox for holding various sizes of mail correspondence and mail parcels, said mailbox comprising:

an elongate and internally hollowed body including, at a generally upper end location, a mail correspondence insertion slot, said body further including a mail storage compartment, said body further being fixedly anchored at a ground location so that at least a portion of said mail storage compartment extends below a surface of the ground location;

parcel access means defined within said body and permitting the depositing of mail parcels into said storage compartment;

a skirt arranged within an interior of said body and preventing unauthorized removal of mail correspondence and mail parcels deposited within said body; and mail retrieval means acting in concert with said parcel access means and permitting the retrieval of the mail correspondence and mail parcels, said mail retrieval means further comprising a platform defined within said elongate and internally hollowed body and upon which is supported the deposited mail correspondence and mail parcels, a bi-directional drive assembly selectively elevating said platform proximate a retrieval door configured within said body and in a mail correspondence and mail parcel retrieval position, said drive assembly lowering said platform to the below ground location in a further mail depositing position.

3. The mailbox as described in claim 2, further comprising a bag supported within said internally hollowed body, said skirt being secured to an upper open end of said bag.

4. The mailbox as described in claim 3, said skirt further comprising a plurality of inwardly directed spear portions terminating in substantially pointed ends.

5. The mailbox as described in claim 4, further comprising at least one circumferentially extending and suspending lip associated with said bag and said skirt, said lip supporting said bag within said body.

6. A theft-preventative mailbox for holding various sizes of mail correspondence and mail parcels, said mailbox comprising:

an elongate and internally hollowed body including, at a generally upper end location, a mail insertion slot, an upwardly and forwardly angled mail inserting end within which said mail insertion slot is defined, said body further including a mail storage compartment;

a skirt arranged within an interior of said hollowed body and at a desired location relative to at least said mail insertion slot, said skirt incorporating a number of inwardly directed and flexible spears, each exhibiting a substantially pointed end, the configuration of the spears being such that, in response to insertion of mail correspondence and parcels, said spears deflect to allow one-way conveyance of deposited mail; and mail retrieval means in proximity to said mail storage compartment and permitting the retrieval of the mail correspondence and mail parcels, said mail retrieval means further comprising said mail inserting end being hingedly connected to said elongate body.

7. A theft-preventative mailbox for holding various sizes of mail correspondence and mail parcels, said mailbox comprising:

an elongate and internally hollowed body including, at a generally upper end location, a mail insertion slot, said body further including a mail storage compartment;

a skirt arranged within an interior of said hollowed body and at a desired location relative to at least said mail insertion slot, said skirt incorporating a number of inwardly directed and flexible spears, each exhibiting a substantially pointed end, the configuration of the spears being such that, in response to insertion of mail correspondence and parcels, said spears deflect to allow one-way conveyance of deposited mail; and mail retrieval means in proximity to said mail storage compartment and permitting the retrieval of the mail correspondence and mail parcels, said retrieval means further comprising a door hingedly secured to a top surface of said upper end location, said door including a locking mechanism which is accessible by a mail delivery individual.

8. The mailbox as described in claim 7, said locking mechanism further comprising a powered locking means associated with said hingedly secured door and activated by an electric motor.

9. A theft-preventative mailbox for holding various sizes of mail correspondence and mail parcels, said mailbox comprising:

an elongate and internally hollowed body including, at a generally upper end location, a mail insertion slot, said body further including a mail storage compartment, a plurality of stakes extending outwardly and downwardly from an exterior surface of said elongate body and embedded within an underground location;

a skirt arranged within an interior of said hollowed body and at a desired location relative to at least said mail insertion slot, said skirt incorporating a number of inwardly directed and flexible spears, each exhibiting a substantially pointed end, the configuration of the spears being such that, in response to insertion of mail correspondence and parcels, said spears deflect to allow one-way conveyance of deposited mail; and mail retrieval means in proximity to said mail storage compartment and permitting the retrieval of the mail correspondence and mail parcels.

10. A theft-preventative mailbox for holding various sizes of mail correspondence and mail parcels, said mailbox comprising:

an elongate and internally hollowed body including, at a generally upper end location, a mail insertion slot, said body further including a mail storage compartment;

a skirt arranged within an interior of said hollowed body and at a desired location relative to at least said mail insertion slot, said skirt incorporating a number of inwardly directed and flexible spears, each exhibiting a substantially pointed end, the configuration of the spears being such that, in response to insertion of mail correspondence and parcels, said spears deflect to allow one-way conveyance of deposited mail; and mail retrieval means in proximity to said mail storage compartment and permitting the retrieval of the mail correspondence and mail parcels, said retrieval means further comprising a door hingedly secured to a front surface of said body, a locking mechanism being associated with said door.

11. The mailbox as described in claim 10, said mail retrieval means further comprising a platform defined within said elongate and internally hollowed body and upon which is supported the deposited mail correspondence and mail parcels, a bi-directional drive assembly selectively elevating said platform proximate said door in a mail correspondence and mail parcel retrieval position, said drive assembly lowering said platform to an underground location in a further mail depositing position.

12. The mailbox as described in claim 11, further comprising an electric motor for actuating said bi-directional drive assembly and for elevating and lowering said platform.

13. The mailbox as described in claim 12, further comprising a remote control mechanism for selectively activating and deactivating said electric motor.

14. The mailbox as described in claim 11, said bi-directional drive assembly further comprising a vertically actuated and elongate fluid cylinder, said platform being secured to an upper end of a piston arm extending from said cylinder.

15. A theft-preventative mailbox for holding various sizes of mail correspondence and mail parcels, said mailbox comprising:

an elongate and internally hollowed body including, at a generally upper end location, a mail insertion slot, said body further including a mail storage compartment;

a skirt arranged within an interior of said hollowed body and at a desired location relative to at least said mail insertion slot, said skirt incorporating a number of inwardly directed and flexible spears, each exhibiting a substantially pointed end, the configuration of the spears being such that, in response to insertion of mail correspondence and parcels, said spears deflect to allow one-way conveyance of deposited mail; and mail retrieval means in proximity to said mail storage compartment and permitting the retrieval of the mail correspondence and mail parcels, said mail retrieval means further comprising an elongated bag suspended from an interior of said internally hollowed body, said flexible skirt being secured about an open upper end of said bag.

16. The mailbox as described in claim 15, further comprising at least one annularly extending and suspending lip extending proximate said upper end of said bag and for suspending said bag from said internally hollowed body.

17. A theft-preventative mailbox for holding various sizes of mail correspondence and mail parcels, said mailbox comprising:

an elongate and internally hollowed body including, at a generally upper end location, a mail insertion slot, said body further including a mail storage compartment;

a skirt arranged within an interior of said hollowed body and at a desired location relative to at least said mail insertion slot, said skirt incorporating a number of inwardly directed and flexible spears, each exhibiting a substantially pointed end, the configuration of the spears being such that, in response to insertion of mail correspondence and parcels, said spears deflect to allow one-way conveyance of deposited mail; and mail retrieval means in proximity to said mail storage compartment and permitting the retrieval of the mail correspondence and mail parcels, said retrieval means further comprising an enclosed and upper portion hingedly secured to said elongate body, a locking mechanism being associated with said hingedly secured upper portion and being actuated to an open position by a mail delivery person.

18. The mailbox as described in claim 17, said locking mechanism including a key card swipe and reader.

* * * * *